United States Patent [19]

Weiland et al.

[11] Patent Number: 4,924,908

[45] Date of Patent: May 15, 1990

[54] APPARATUS FOR WITHDRAWING LIQUID FROM A RESERVOIR BY MEANS OF A WATER JET DEVICE

[75] Inventors: Jan A. E. S. Weiland, Deventer; Jan C. van Hattem, Amerongen, both of Netherlands

[73] Assignee: Douwe Egberts Koninklijke Tabaksfabriek-Koffiebranderijen-Theehandel N.V., Utrecht, Netherlands

[21] Appl. No.: 299,154

[22] Filed: Jan. 19, 1989

[30] Foreign Application Priority Data

Jan. 19, 1988 [NL] Netherlands ..... 8800113

[51] Int. Cl.[5] ..... B67D 5/56; B01F 5/04

[52] U.S. Cl. ..... 137/565; 137/888

[58] Field of Search ..... 417/151, 181; 137/888, 137/565; 222/395

[56] References Cited

U.S. PATENT DOCUMENTS

| | | | |
|---|---|---|---|
| 1,233,941 | 7/1917 | Welsh | 417/151 |
| 1,947,994 | 2/1934 | Larson | 137/888 |
| 3,552,568 | 1/1971 | Wade | 137/888 X |
| 4,586,854 | 5/1986 | Newman | 137/888 |
| 4,653,242 | 3/1987 | van de Haar et al. . | |
| 4,653,252 | 3/1987 | Haar | 53/449 |

FOREIGN PATENT DOCUMENTS

| | | |
|---|---|---|
| 1027557 | 3/1986 | Fed. Rep. of Germany . |
| 3607823 | 9/1987 | Fed. Rep. of Germany . |

*Primary Examiner*—Alan Cohan

*Attorney, Agent, or Firm*—Cushman, Darby & Cushman

[57] ABSTRACT

A method and an apparatus for withdrawing liquid from a reservoir, such as a concentrate container, by means of a water jet device received in a clamping device. The reservoir is provided with an outlet opening having a valve mechanism fitted with a lip seal. The water jet device connects on the one hand to a water supply hose and on the other hand to a drain spout. The method and apparatus are characterized in that the reservoir is a flexible bag fitted with a connector or insert. The bag is received in a reservoir box whose underside has an opening for the passage of the connector or insert, as well as a plurality of passages for receiving the attachment elements of the clamping device.

5 Claims, 2 Drawing Sheets

APPARATUS FOR WITHDRAWING LIQUID FROM A RESERVOIR BY MEANS OF A WATER JET DEVICE

BACKGROUND OF THE INVENTION

This invention relates to a method of withdrawing liquid from a reservoir, such as a concentrate container, by means of a water jet device received in a clamping device, this reservoir having an outlet opening fitted with a valve mechanism provided with a lip seal, while further on the one hand a water supply hose connects to the water jet device and on the other hand a drain spout.

In a similar method disclosed in German Offenlegungsschrift 36 07 623, a container made of synthetic plastics is provided with lips having hook shaped ends arranged for coaction with complementary openings of the clamping device to which the said water jet device has been previously attached.

SUMMARY OF THE INVENTION

It is an object of the present invention to provide an improvement in this known method, in particular with respect to the connection between the reservoir and the water jet system, as well as an improvement in the emptying of the reservoir.

To that effect the method according to the present invention is characterized in that the reservoir is a flexible bag having a connector or insert, this bag being received in hanging state in a reservoir box whose underside is provided with an opening for the passage of the insert, as well as with a plurality of passages for receiving the attachment elements of the clamping device.

In this manner, use can be made of a reservoir box with a flexible bag similar to in the apparatus described in Applicants' U.S. Pat. No. 4,653,252, be it that in the latter, use is made of a compressible hose, fitted with two valves, whereas the present application uses a connector or insert with a passageway therein and made from hard material, which on the one hand can be fitted in an opening of a flexible bag and serves for attachment to the box and on the other hand includes outlet valve means arranged for coaction with a water jet device.

The present invention further relates to an apparatus for attaching a water jet device to a reservoir, such as a concentrate container, provided with a connector or insert, this apparatus being characterized in that the reservoir is a flexible bag fitted in hanging state in a reservoir box, while the clamping device, adapted for receiving the water jet device consists of two parts interconnected pivotally, at least one having attachment elements arranged for coaction with openings in the bottom of the reservoir box.

For a proper fixation of the clamping device relative to the reservoir box, the attachment elements may be designed as hook-shaped members carried by the upper part of the two-part clamping device with the lower part of the clamping device being provided at its free end with an upward extension positioned and arranged in such a manner that, after attachment of the upper portion of the clamping device to the reservoir box, and after closure of the clamping device, the extension extends behind the hook-shaped elements through the opening in the reservoir box.

Conical portions may be provided in the reservoir box adjacent the passage for the connector or insert in such a manner that the liquid contained in the flexible bag in the position of use is urged towards the connector or insert.

Furthermore, the connector or insert may be provided with projections extending into the interior of the flexible bag, so that the connector or insert always remains "open".

A construction thus designed has the advantage of providing, in addition to an effective seal between the water jet device and the connector or insert, complete emptying of the flexible bag.

An additional advantage is that the concentrate container is always properly shielded towards the exterior.

BRIEF DESCRIPTION OF THE DRAWINGS

One embodiment of the method and of the apparatus for emptying a reservoir by means of a water jet device according to the present invention will now be described, by way of example, with reference to the accompanying drawings, in which.

DETAILED DESCRIPTION

Figure 1:
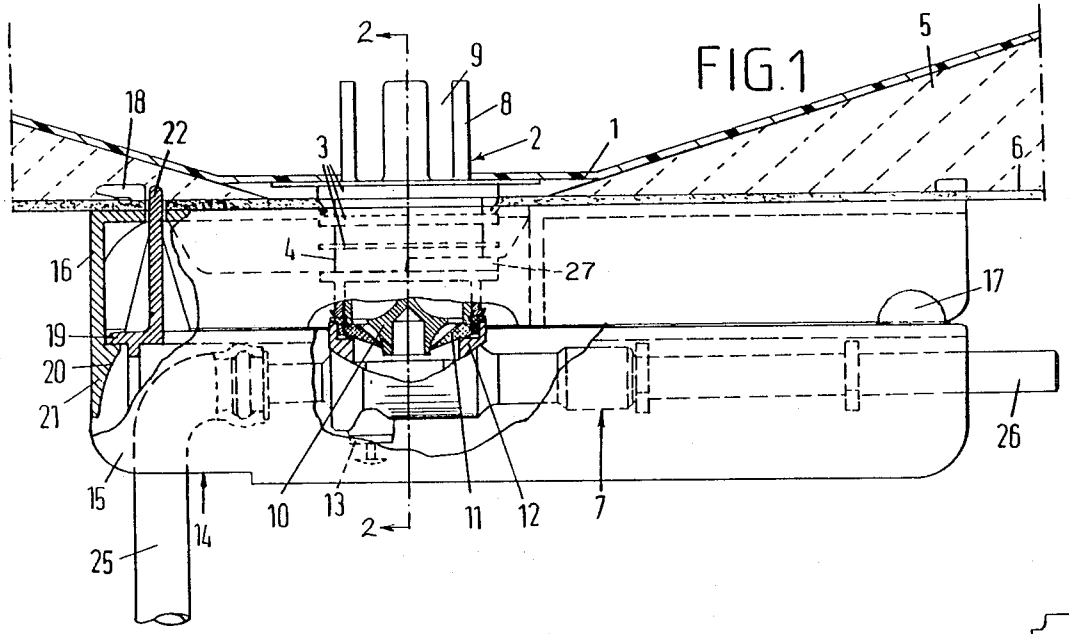
FIG. 1 is a diagrammatic part-sectional elevation of the lower part of a reservoir box wherein a part of the flexible bag with the connector or insert, as well as a water jet device are shown in the position of use.
Figure 2:
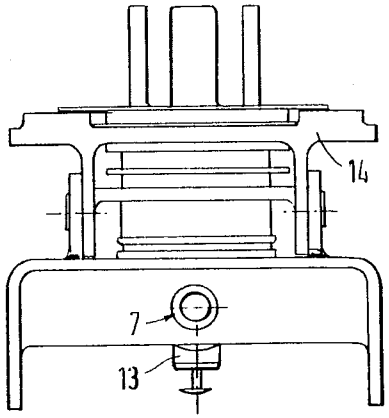
FIG. 2 is a diagrammatic cross-sectional view on the line II—II of FIG. 1, with a number of parts being omitted.
Figure 3:
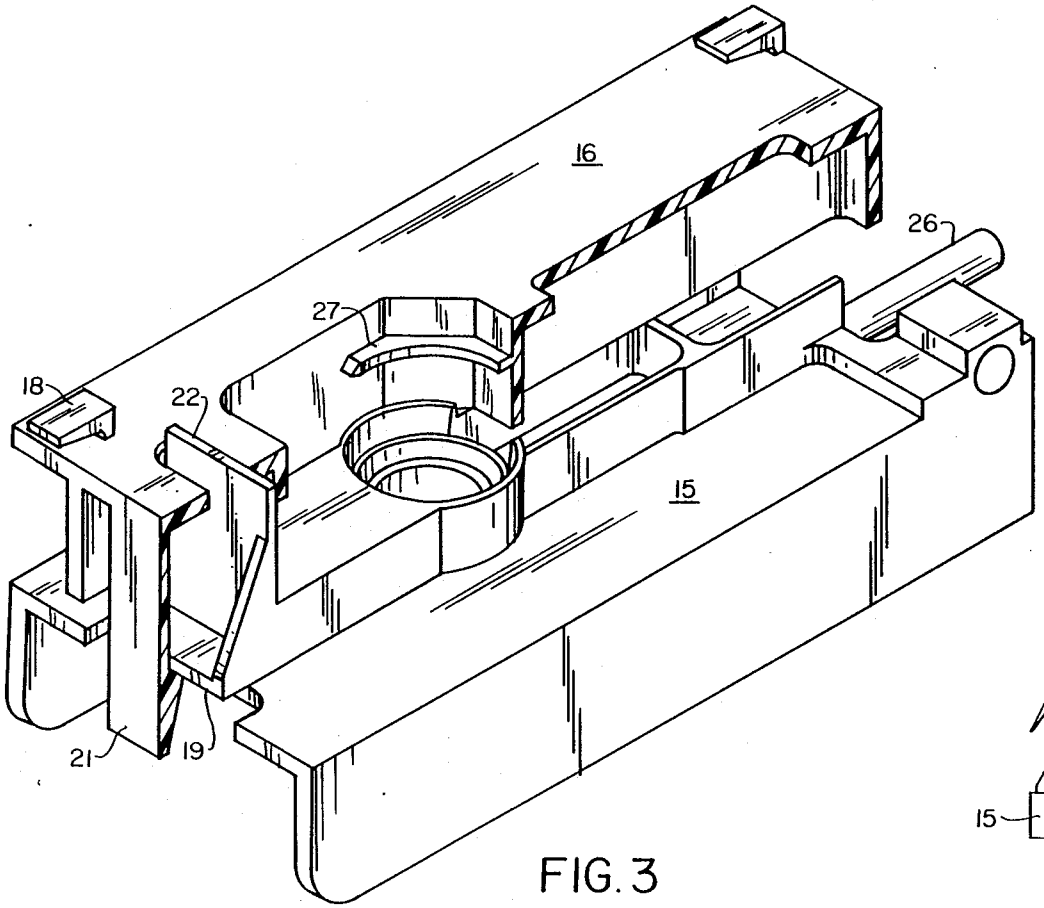
FIG. 3 is a perspective view, on an enlarged scale, and with parts broken away and sectioned to expose otherwise obscured detail, of the foot of the apparatus of FIGS. 1 and 2.
Figure 4:
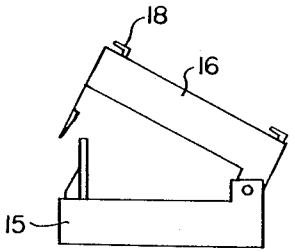
FIG. 4 is a reduced-scale side elevation view thereof.

As shown in the drawings, a flexible container or bag 1 is provided with a connector or insert 2, consisting of a length of pipe 4 having a plurality of sockets on its exterior. The sockets serve for attachment of the connector or insert to the flexible bag, in an opening of a box 6, and the connection between the connector or insert and a water jet device 7, respectively, which is fitted with a drain spout 25, and a water supply 26, respectively, shown diagrammatically. The box 6 has a conical portion 5 provided on either side of connector or insert 2.

In the position shown in FIG. 1, the connector or insert is provided at its top with projections 8 between which passages 9 are arranged. In this manner, it is ensured that all of the liquid contained in the flexible bag 1 can flow through the passage into the tube 4. The lower end of tube 4 is fitted with a valve mechanism composed of a fixed valve portion 10, which, through interposition of an annular sealing lip 11, is connected to a socket 12 of the water jet device 7. The last is provided in known manner with a pusher device 13. For further details of this construction, reference is made to the earlier cited German patent application No. 36 07 623. The water jet device 7 is accommodated in the lower portion of a foot or base 14, essentially consisting of two parts, i.e. the above-mentioned lower portion 15 and an upper portion 16, which parts are interconnected pivotally at a pin 17.

Element 27 is a part-circular arcuate collar that catches under a rim on the outside of the connector 2 when the bag-in-box 1, 5 is tilted to an upright condition relative to the foot 14.

As shown in FIG. 1, the upper portion 16 of the foot is provided with hook-shaped projections 18 adapted for coaction with openings in the underside of the box 6. For a proper fixation, lower portion 15 of the foot is provided at the side opposite pivot pin 17 with a nose 19 adapted to slide along an oblique portion 20 of an elastic cam 21 of the upper portion 16 of foot 14. The said nose 19, in mounted condition, is formed with an upward extension (portion 22) in such a manner that said extension 22 can extend behind the hook-shaped portion 18 in the respective opening of upper portion 16 of the foot, and the opening in the reservoir box, respectively, just behind the said hook-shaped portion 18, thereby providing for a very simple locking of the assembly.

We claim:

1. Apparatus for withdrawing liquid from a reservoir, comprising:

a reservoir box having a bottom wall provided with an opening;

a flexible bag for containing a supply of liquid to be withdrawn from said flexible bag through said opening, said flexible bag being supported in said reservoir box;

a connector extending as an outlet opening means from within said flexible bag near said bottom wall, down and out of said flexible bag through said opening;

said connector being fitted with a valve mechanism including a normally closed lip seal which, while externally subjected to lowered pressure flexes to an open condition which permits liquid contained in the bag to flow out through the connector;

a water jet assembly comprising:

a water jet device arranged to be connected at an inlet end thereof to a supply of pressurized water and to be connected at an outlet end thereof to a drain for water mixed with liquid withdrawn from said flexible bag by operation of said water jet device, said water jet device including a socket through which water is jetted, in use, for creating a lowered pressure on said lip seal, said lip seal arranged to be communicated by said socket, in use, to water jetted through said socket;

means defining a plurality of passages through said bottom wall of said reservoir box, said passages being spaced from said opening for said connector;

a clamping device at least partly housing said water jet assembly, and supporting said socket; and a plurality of hook-shaped projections provided on said clamping device and extending through respective ones of said passages into said reservoir box and thereby securing said box bottom onto said clamping device at a plurality of locations around said opening.

2. The apparatus of claim 1, further including:

a locking means movably provided on said clamping device in relation to said hook-shaped projections, said locking means being movable between a locking position in which said locking means coact with said box bottom to prevent said hook-shaped projections from being withdrawn from said passages, and an unlocking position in which said locking means are withdrawn from coaction with said box bottom so as to permit said hook-shaped projections to be withdrawn from said passages so that said reservoir box and connector can be respectively disconnected from said clamping device and said socket.

3. The apparatus of claim 2, wherein:

said clamping device comprises a first portion hinged by hinge means to a second portion, said hook-shaped projections are provided on said first portion of said clamping device, said locking means are provided on said second portion of said clamping device, and said locking means is moved from said unlocking position to said locking position by pivoting said second portion of said locking means relative to said first portion of said locking means, about said hinge means; and a releasable latch means for latching said first and second portions of said clamping device together with said locking means in said locking position.

4. The apparatus of claim 1, wherein:

said bottom wall of said reservoir box is provided with an internal surface which slopes downwards towards said opening and said flexible bag is supported at least in part on said internal surface, so that liquid contained in said flexible bag tends to drain towards said connector.

5. The apparatus of claim 4, wherein:

said connector comprises a tubular element having an open upper end having a perimetrical edge, said edge having provided thereon a plurality of axially upward projections spaced from one another in a circumferential direction on said edge thereby defining passages between them located such that liquid when contained in the flexible bag may flow inwardly between said projections through said passages, and down through said connector.

* * * * *

UNITED STATES PATENT AND TRADEMARK OFFICE

CERTIFICATE OF CORRECTION

PATENT NO. : 4,924,908

DATED : May 15, 1990

INVENTOR(S) : Jan Spernaweiland, Jan Van Hattem

It is certified that error appears in the above-identified patent and that said Letters Patent is hereby corrected as shown below:

ON THE FIRST INFORMATION PAGE:

Please Change:

"(75) Inventors: Jan A.E.S. Weiland, . . ." to

--(75) Inventors: J. A. Sperna Weiland,..--

Signed and Sealed this

Twentieth Day of August, 1991

*Attest:*

HARRY F. MANBECK, JR.

*Attesting Officer*

*Commissioner of Patents and Trademarks*